US006805585B1

(12) United States Patent
Ko

(10) Patent No.: US 6,805,585 B1
(45) Date of Patent: Oct. 19, 2004

(54) LOW PROFILE ELECTRICAL CONNECTOR ASSEMBLY

(75) Inventor: David (Tso-Chin) Ko, Fullerton, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/774,179

(22) Filed: Feb. 6, 2004

(51) Int. Cl.[7] ..... H01R 13/648
(52) U.S. Cl. ..... 439/607; 439/946; 439/629
(58) Field of Search ..... 439/607, 609, 439/76.1, 629, 630, 946, 108, 660, 579, 497, 101; 361/737

(56) References Cited

U.S. PATENT DOCUMENTS 5,478,260 A * 12/1995 Kaufman et al. ..... 439/609
5,586,893 A * 12/1996 Mosquera ..... 439/108
5,890,917 A * 4/1999 Ishida et al. ..... 439/101
6,273,753 B1 8/2001 Ko
6,305,978 B1 10/2001 Ko et al.
6,338,652 B1 1/2002 Ko
6,341,069 B1 * 1/2002 Torlotin ..... 361/737
6,672,887 B1 * 1/2004 Yu ..... 439/108
6,685,495 B1 * 2/2004 Ko ..... 439/353
6,705,893 B1 * 3/2004 Ko ..... 439/607

* cited by examiner

*Primary Examiner*—Tho D. Ta
(74) *Attorney, Agent, or Firm*—Wei Te Chung

(57) ABSTRACT

An electrical connector assembly (1) includes an electrical connector (10) and a module (20). The electrical connector includes an insulative housing (11) defining a mating port (173), a number of contacts (12) received in the insulative housing and exposed into the mating port, and a shield member (13) surrounding the insulative housing. The module includes a daughter card (21) having a mating edge inserted into the mating port of the electrical connector and a number conductive pads (211) arranged on the mating edge and electrically connecting with the contacts, and a shell (22) covering the daughter card and having shield plate (220) electrically connecting with the shield member of the electrical connector.

9 Claims, 5 Drawing Sheets

LOW PROFILE ELECTRICAL CONNECTOR ASSEMBLY

BACKGROUND OF THE INVENTION

1. Field of the Invention

The present invention relates to an electrical connector assembly, and particularly to an electrical connector assembly having a low profile.

2. Description of Related Art

Most notebook computers come with slots for PC cards, and the consumers are quite familiar with them. While PC central processing unit (CPU) clock frequencies are rising along with the speeds of peripheral technologies like PCI Express and Gigabit Ethernet, the PC Card standard would not be able to handle developing applications smoothly. A new specification named NEWCARD will take the next generation in PC Card evolution. In addition to the successful characteristics of the PC Card: reliability, ease of use and wide industry support while delivering external expansion with reduced size, higher speed, lower costs and support of advanced serial I/O technologies, USB 2.0 and PCI Express, the new specification offers key advantages in terms of faster speed and smaller size. So, devices which connect the NEWCARDs and the PCI Express interfaces in the notebooks must be low profile interconnection and also meet the signal integrity requirement of PCI Express in the notebook application.

SUMMARY OF THE INVENTION

An object of the present invention is to provide an electrical connector assembly having a low profile.

To achieve the above object, an electrical connector assembly in accordance with the present invention comprises an electrical connector and a module. The electrical connector comprises an insulative housing defining a mating port, a plurality of contacts received in the insulative housing and exposed into the mating port, and a shield member surrounding the insulative housing. The module comprises a daughter card having a mating edge inserted into the mating port of the electrical connector and a plurality of conductive pads arranged on the mating edge and electrically connecting with the contacts, and a shell covering the daughter card and having shield plate electrically connecting with the shield member of the electrical connector.

Other objects, advantages and novel features of the invention will become more apparent from the following detailed description when taken in conjunction with the accompanying drawings.

DETAILED DESCRIPTION OF THE INVENTION

Figure 1:
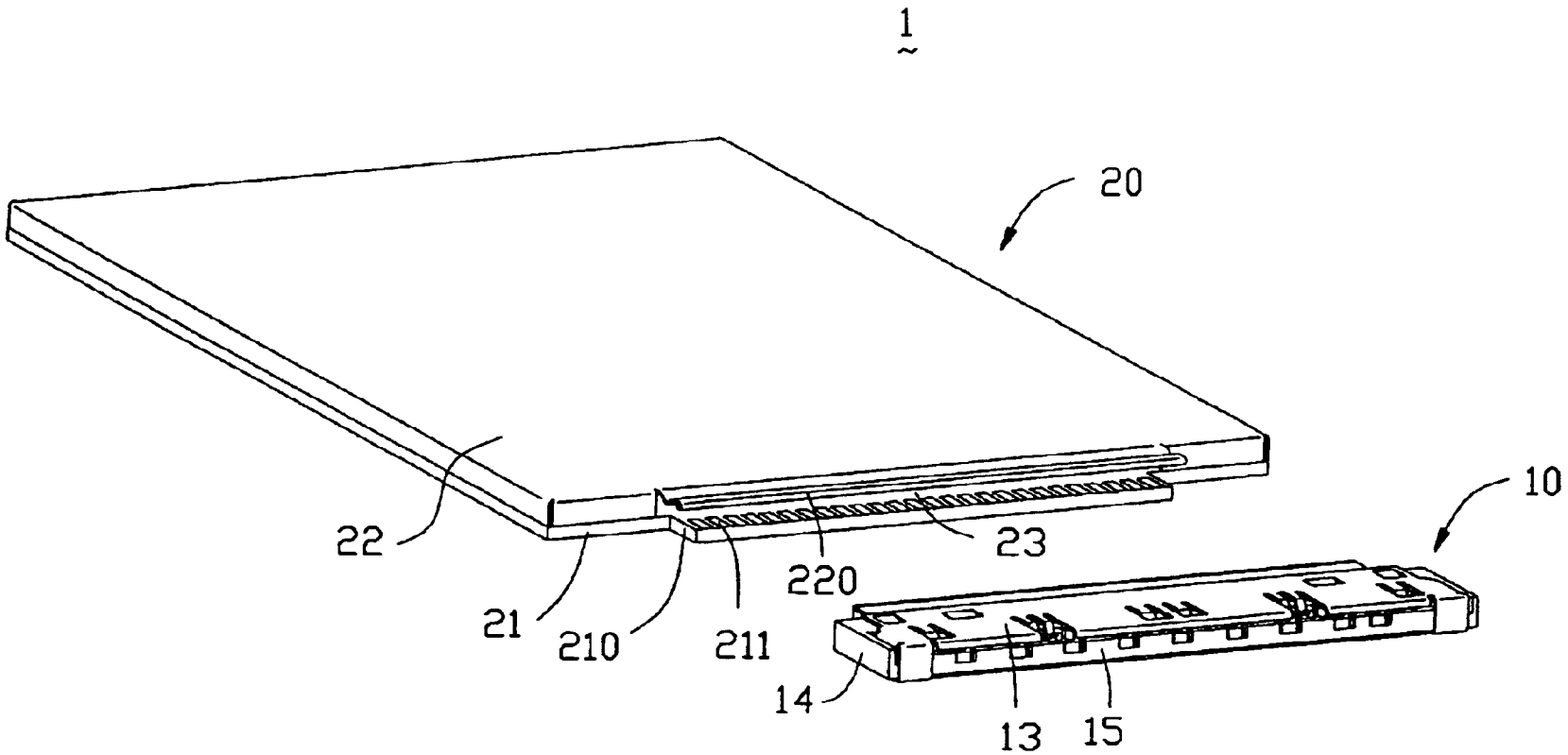
FIG. 1 is an exploded perspective view of an electrical connector assembly in accordance with the present invention.

Referring to FIG. 1, an electrical connector assembly 1 in accordance with the present invention comprises an electrical connector 10 and a module 20 for mating with the electrical connector 10.

Figure 2:
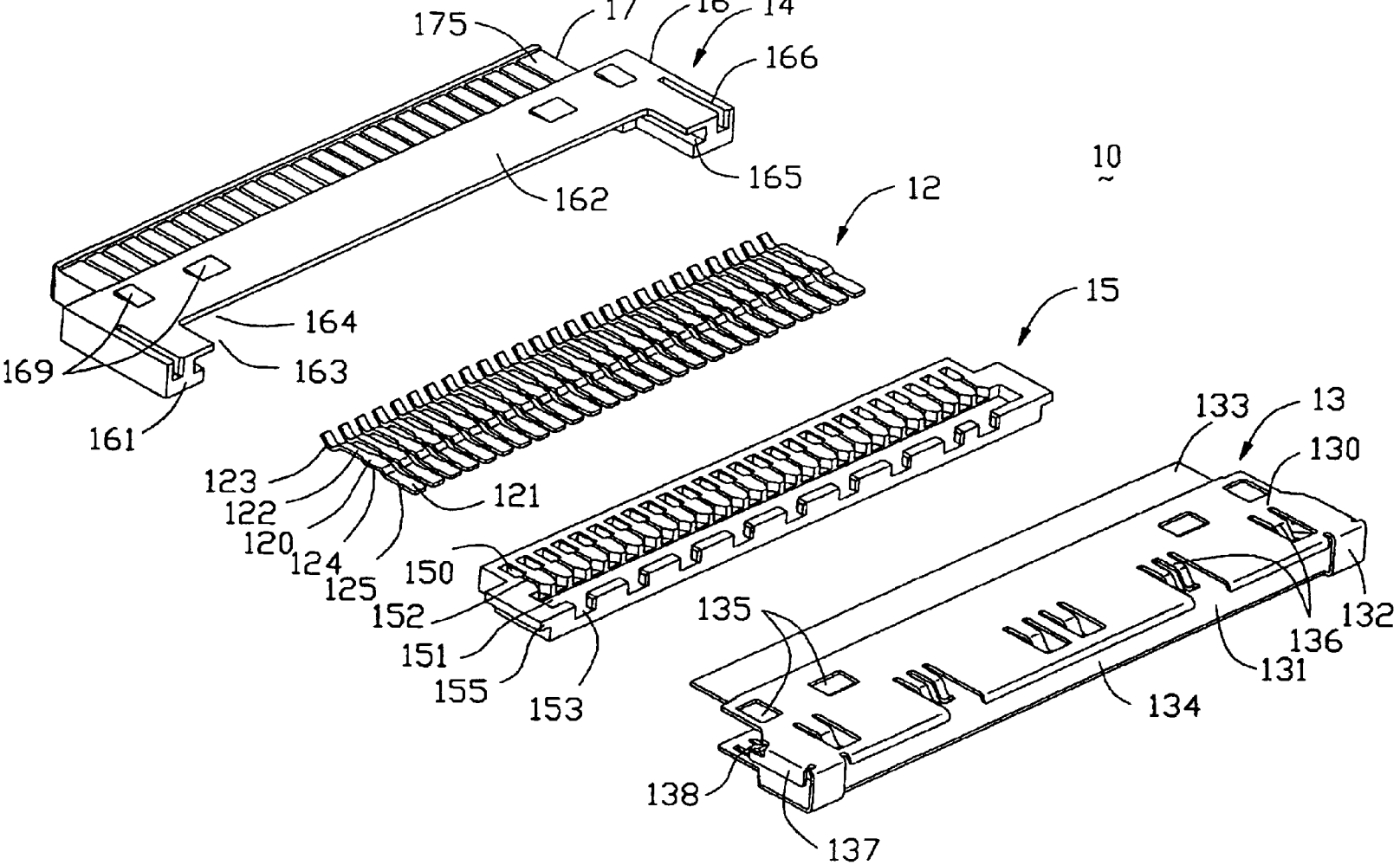
FIG. 2 is a rear, top exploded perspective view of an electrical connector of the connector assembly of FIG. 1.
Figure 3:
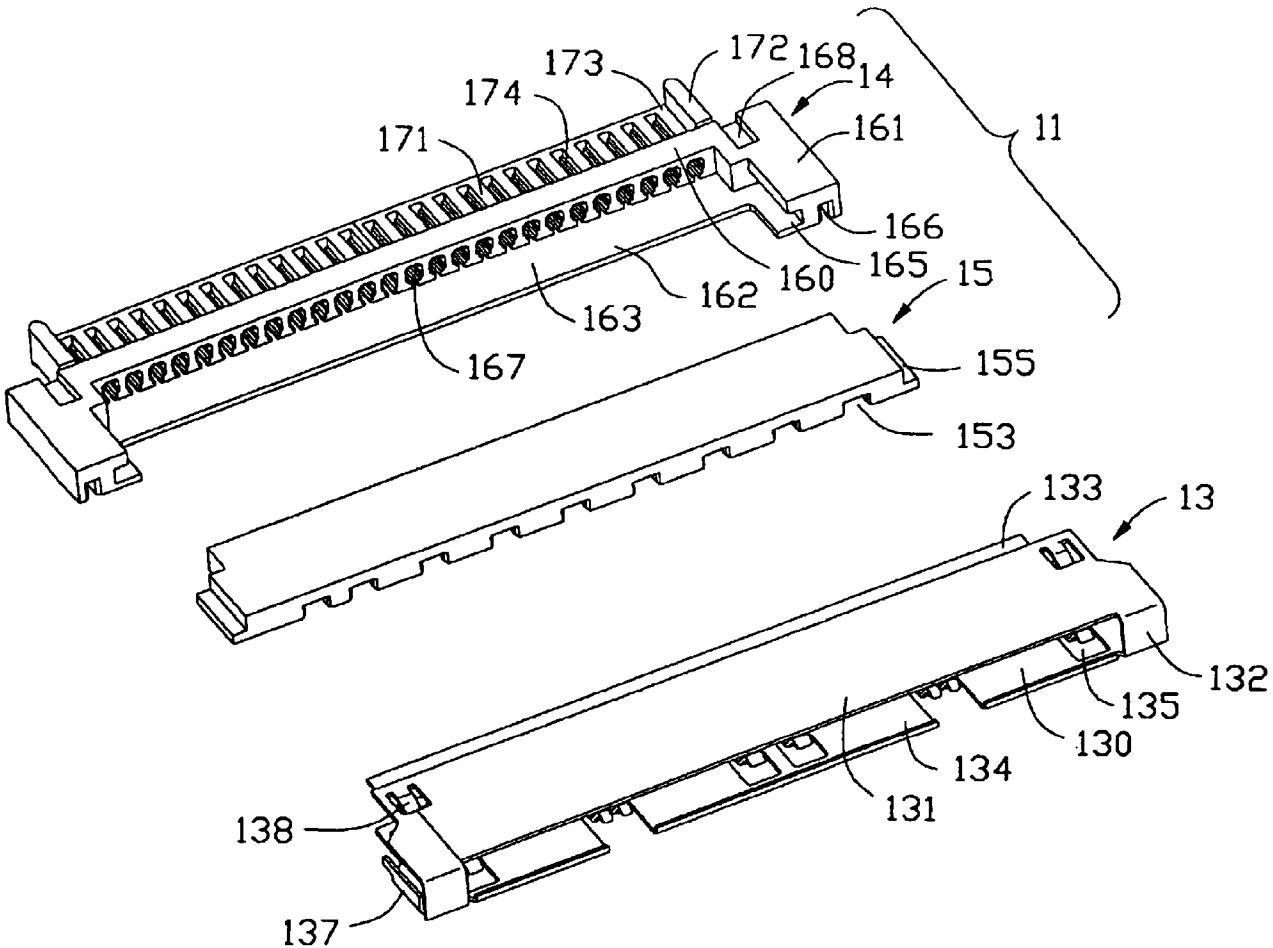
FIG. 3 is a rear, bottom exploded perspective view of the electrical connector of FIG. 2 but with contacts thereof being taken away.

Referring to FIGS. 2 and 3, the electrical connector 10 comprises an insulative housing 11, a plurality of contacts 12, and a shield member 13. The insulative housing 11 comprises a first housing 14 and a second housing 15. The first housing 14 comprises an elongated base 16 and a mating portion 17 extending forwardly from the base 16. The base 16 comprises a front wall 160, a pair of side walls 161 extending rearwardly from opposite ends of the front wall 160, and an upper wall 162 extending rearwardly from an upper end of the front wall 160. The front wall 160, the side walls 161 and the upper wall 162 together define a cavity 163 therebetween. The upper wall 162 defines a cutout 164 at a rear end thereof. The side walls 161 define a pair of channels 165 in inner sides thereof to communicate with the cavity 163, and a pair of slots 166 on upper sides thereof. The front wall 160 defines a plurality of holes 167 extending therethrough in a front-to-rear direction and in communication with the cavity 163. The base 16 defines a pair of notches 168 in a bottom face adjacent to opposite ends thereof. A plurality of blocks 169 are formed on an upper face of the base 16 adjacent opposite ends thereof. The mating portion 17 comprises a mating plate 171, and a pair of end walls 172 extending downwardly from opposite ends of the mating plate 171. The mating plate 171 and the end walls 172 together define a mating port 173. The mating plate 171 defines a plurality of passageways 174 in a lower side thereof and in communication with the holes 167 of the base 16, and a groove 175 in an upper side thereof.

The second housing 15 defines a plurality of apertures 150 in an upper face adjacent a front end thereof, a recess 151 in the upper face adjacent to a rear end thereof, and a plurality of gaps 152 each communicating with a corresponding aperture 150 and the recess 151. A plurality of cutouts 153 are defined in a rear side of the recess 151. The second housing 15 defines a plurality of retention slits 154 (shown in FIG. 5) extending rearwardly from a front face thereof. Each of the retention slits 154 communicates with a corresponding aperture 150. A pair of flanges 155 are formed on opposite ends of the second housing 15.

Each of the contacts 12 comprises a tail portion 121, a body portion 120 upwardly bent from the body portion 120 and extending forwardly, a resilient arm 122 extending forwardly from the body portion 120, and a curved portion 123 formed on a free end of the resilient arm 122. The tai portion 121 and the body portion 120 are respectively formed with a pair of barbs 125, 124 on opposite sides thereof.

The shield member 13 is stamped and formed from a metal sheet and comprises an upper plate 130, a lower plate 131 opposite to the upper plate 130, a pair of connect plates 132 connecting with rear edges of the upper and the lower plates 130, 131 at opposite ends thereof, and a projecting plate 133 extending forwardly from a front edge of the upper plate 130. A shield space 134 is formed between the upper and the lower plates 130, 131. The upper plate 130 defines a plurality of openings 135 adjacent opposite ends thereof. The upper plate 130 has a plurality of resilient tabs 136 extending into the shield space 134 adjacent a rear end thereof, and a pair of side flaps 137 extending downwardly from opposite edges of the upper plate 130. The lower plate 131 has a pair of retention tabs 138 extending into the shield space 134 adjacent opposite ends thereof.

Figure 5:
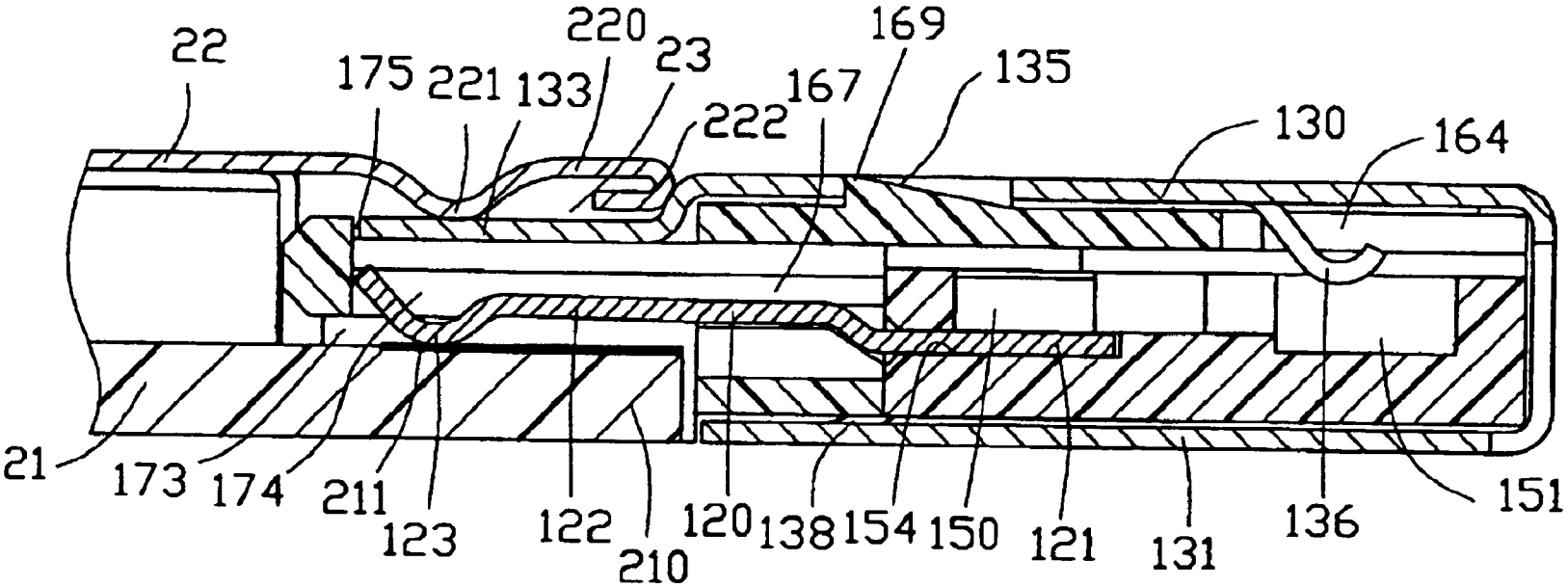
FIG. 5 is a cross-sectional view taken along line 5—5 of FIG. 4.

Referring to FIGS. 1 and 5, in assembly, the tail portions 121 of the contacts 12 are inserted into the retention slits 154 of the second housing 15 and exposed into the apertures 150 for soldering to conductors of a cable (not shown). The barbs 125 of the tail portions 121 engage with inner sides of the retention slits 154. The second housing 15 is then received in the cavity 163 of the first housing 14 with a bottom face thereof acting as a bottom face of the base 16 of the first housing 14, thereby reducing a height of the electrical connector 1. The flanges 155 of the second housing 15 are received in the channels 165 of the first housing 14. The body portions 120 of the contacts 12 are received in the holes 167 of the first housing 14 with the barbs 124 engaging with inner sides of the holes 167. The resilient arms 122 of the contacts 12 are received in the passageways 174 with the contact portions 123 exposed into the mating port 173. The first housing 14 and the second housing 15 together form the insulative housing 11. The shield member 13 is finally assembled to the insulative housing 11. The upper plate 130 of the shield member 13 covers the upper face of the base 16 of the first housing 14 with the openings 135 engagably receiving the blocks 169 of the first housing 14, and with the side flaps 137 received in the slots 166 of the first housing 14. The resilient tabs 136 extend into the recess 151 of the second housing 15 through the cutout 164 of the first housing 14 for electrically connecting to a grounding bus (not shown) received in the recess 151. The lower plate 131 of the shield member 13 covers the bottom face of the base 16 of the first housing 14 with the retention tabs 138 received in the notches 168 of the base 16. The projecting plate 133 of the shield member 13 is received in the groove 175 of the first housing 14 for shielding the mating plate 171.

Referring back to FIG. 1 in conjunction with FIG. 5, the module 20 comprises a daughter card 21 and a shell 22 assembled on the daughter card 21. The daughter card 21 comprises a mating edge 210 having a plurality of conductive pads 211 arranged on an upper side thereof. The shell 22 comprises a shield plate 220 opposite to the mating edge 210 of the daughter card 21. A mating space 23 is defined between the mating edge 210 of the daughter card 21 and the shield plate 220 of the shell 22. The shield plate 220 has a curved contact portion 221 projecting into the mating space 23. A free end of the shield plate 220 is downwardly folded and backwardly extends into the mating space 23 to function as a lead-in 222.

Figure 4:
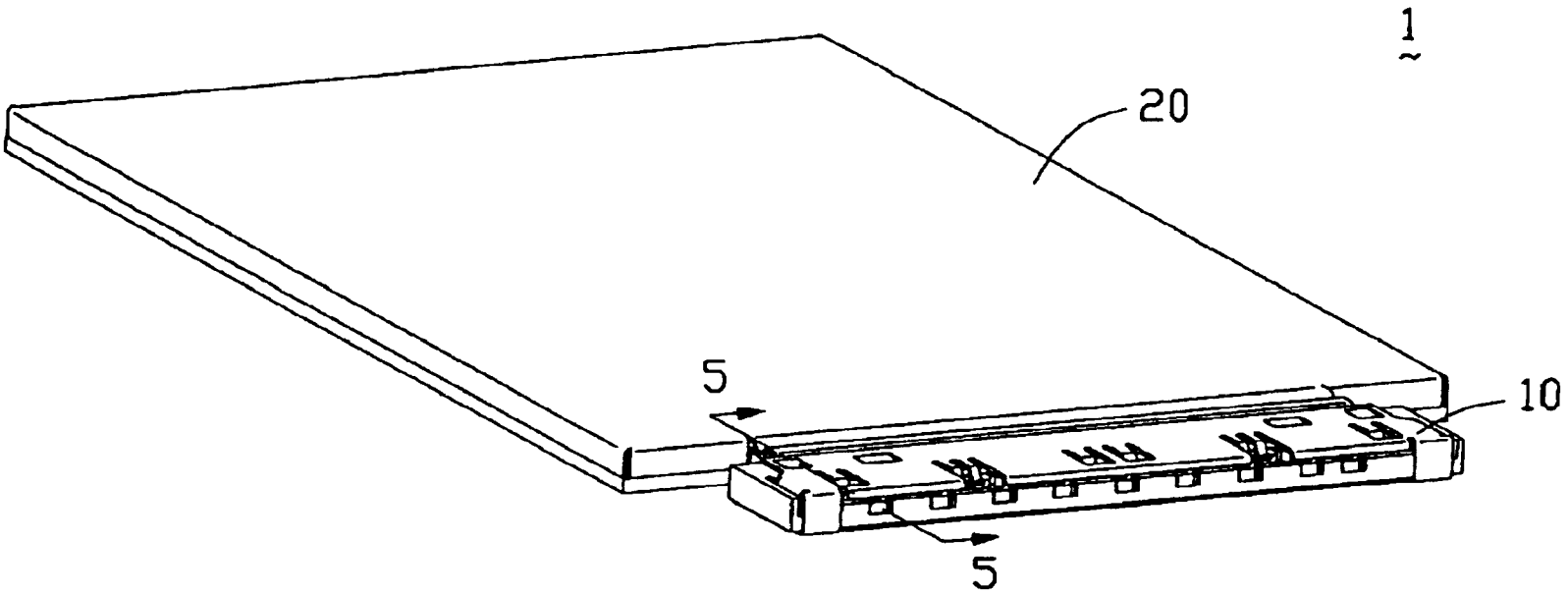
FIG. 4 is an assembled perspective view of the electrical connector assembly of FIG. 1.

Referring to FIGS. 4 and 5, when the electrical connector 10 mates with the module 20, the mating edge 210 of the daughter card 21 is inserted into the mating port 173 of the electrical connector 10 with the conductive pads 211 upwardly pressing against the contact portions 123 of the contacts 12 for establishing electrical connection therebetween. The mating plate 171 is inserted into the mating space 23 of the module 20. The projecting plate 133 of the shield member 13 upwardly presses against the contact portion 221 of the shell 22 for establishing electrical connection therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an electrical connector comprising:

an insulative housing comprising a mating port and a mating plate above the mating port;

a plurality of contacts received the insulative housing, each of the contacts comprising a contact portion exposed into the mating port; and a shield member surrounding the insulative housing and comprising a projecting plate covering the mating plate of the insulative housing; and a module comprising:

a daughter card comprising a mating edge inserted into the mating port of the insulative housing, and a plurality of conductive pads arranged on the mating edge and electrically connecting with the contact portions of the contacts; and a shell assembled on the daughter card and comprising a shield plate over the mating edge of the daughter card, the shield plate and the mating edge defining a mating space therebetween for receiving the mating plate of the insulative housing, the shield plate electrically connecting with the projecting plate of the shield member.

2. The electrical connector assembly as claimed in claim 1, wherein the mating plate of the mating portion defines a groove receiving the projecting plate of the shield member.

3. The electrical connector assembly as claimed in claim 1, wherein the shield plate of the shell has a curved contact portion contacting with the projecting plate of the shield member.

4. The electrical connector assembly as claimed in claim 1, wherein the shield plate of the shell has a free end downwardly folded and extending backwardly to function as a lead-in.

5. The electrical connector assembly as claimed in claim 1, wherein the insulative housing comprises a first housing defining a cavity, and a second housing received in the cavity of the first housing.

6. The electrical connector assembly as claimed in claim 5, wherein the first housing defines a plurality of holes communicating with the cavity, and a plurality of passageways extending along a lower side of the mating plate and communicating with the holes, and wherein each of the contacts comprises a tail portion retained in the second housing, a body portion engagably received in the holes of the first housing, a resilient arm received in the passageways, and a contact portion projecting into the mating port.

7. An electrical connector assembly comprising:

a module including:

a daughter card defining thereof an interior surface with circuit traces on a front region of said interior surface;

a metallic shell close to and immoveable relative to the daughter board, a mating space defined between the shell and said front region;

an electrical connector including:

an insulative housing including a forwardly projecting mating plate defining opposite first and second surfaces thereon;

a plurality of passageways extending along a front-to-back direction in the housing and through the second surface and the facing to an exterior in a vertical direction perpendicular to said front-to-back direction;

a plurality of contacts disposed in the corresponding passageways, respectively, each of said contacts including a curved portion projecting out of the corresponding passageway and into the exterior; and a metallic shield enclosing said housing, a front portion of said metallic shield specifically covering the first surface of said mating plate while uncovering said second surface in said vertical direction; wherein when said connector is assembled to the module, the mating plate is inserted into the mating space under a condition that the front portion of the metallic shield mechanically and space electrically engages the shell, and the curved portions of the contacts engage the corresponding circuit traces.

8. The assembly as claimed in claim 7, wherein a height of said connector is similar to that of the module.

9. The assembly as claimed in claim 7, wherein said shield covers both upper and lower sides of the housing while said shell only covers an upper side of the daughter card.

* * * * *